US010767841B2

(12) United States Patent
Pessoni

(10) Patent No.: US 10,767,841 B2
(45) Date of Patent: Sep. 8, 2020

(54) LIGHTING SYSTEM

(71) Applicant: ARTEMIDE S.p.A., Milan (IT)

(72) Inventor: Laura Pessoni, Milan (IT)

(73) Assignee: ARTEMIDE S.p.A. (IT)

( * ) Notice: Subject to any disclaimer, the term of this patent is extended or adjusted under 35 U.S.C. 154(b) by 0 days.

(21) Appl. No.: 16/384,698

(22) Filed: Apr. 15, 2019

(65) Prior Publication Data

US 2019/0316764 A1 Oct. 17, 2019

(30) Foreign Application Priority Data

Apr. 16, 2018 (IT) ..... 102018000004554

(51) Int. Cl.
*F21V 21/005* (2006.01)

(52) U.S. Cl.
CPC ..... *F21V 21/005* (2013.01)

(58) Field of Classification Search
None
See application file for complete search history.

(56) References Cited

U.S. PATENT DOCUMENTS

| | | | |
|---|---|---|---|
| 2004/0196659 | A1 | 10/2004 | Chen |
| 2009/0135602 | A1 | 5/2009 | Liu et al. |
| 2011/0079697 | A1 | 4/2011 | Muller et al. |
| 2017/0030561 | A1 | 2/2017 | Dix et al. |

FOREIGN PATENT DOCUMENTS

| | | | |
|---|---|---|---|
| DE | 202017106102 | U1 | 1/2018 |
| FR | 1398079 | A | 5/1965 |

OTHER PUBLICATIONS

Italian Search Report, Ministero dello Sviluppo Economico, IT2018000004554, dated Apr. 16, 2018, pp. 1-8.

*Primary Examiner* — Elmito Breval
(74) *Attorney, Agent, or Firm* — The Belles Group, P.C.

(57) ABSTRACT

A lighting system comprises at least one plurality of lighting units and at least one joint, connecting two or more units; the joint comprises a central support extending along a first rotation axis and two or more arms, radially projecting from the support and hinged in a rotary manner to the support to rotate with respect to the support about the first rotation axis; each arm is hinged in a rotary manner about a second rotation axis, orthogonal to the first rotation axis to a connection head fixed to a lighting unit.

16 Claims, 5 Drawing Sheets

LIGHTING SYSTEM

CROSS REFERENCE TO RELATED APPLICATIONS

This patent application claims priority from Italian patent application No. 102018000004554 filed on Apr. 16, 2018, the entire disclosure of which is incorporated herein by reference.

TECHNICAL FIELD

The present invention relates to a lighting system.

Lighting systems are known comprising lighting modules, which can be variously connected to one another in different spatial configurations.

BACKGROUND

However, in general, it seems that with the known modular lighting systems there is still room for improvement, particularly in terms of ease of production and assembly, as well as versatility.

For example, most known modular systems allow the various modules to be assembled only in one or two directions, consequently allowing the creation of final configurations, which are substantially linear or two-dimensional.

Furthermore, in general, in known systems, modules can only be connected to one another with predetermined inclinations (and normally on a single plane), typically at 90° with respect to one another, or nonetheless with predetermined inclinations.

Thus, known modular systems cannot develop on various levels or have different vertical inclinations.

On the other hand, the lighting sector is constantly searching for technical solutions, which also allow the integration into aesthetically original objects, besides obtaining new concept lighting effects, since not only is the purely functional aspect vital in this sector, but also the aesthetic and emotive component.

BRIEF SUMMARY

It is an object of the present invention to provide a lighting system, which overcomes the evidenced drawbacks of the prior art; in particular, it is an object of the invention to provide a lighting system, which is simple to make and assemble and which allows a wide variety of different spatial configurations to be created, also three-dimensional (i.e. extending not only in two directions, but in three directions) and with different inclinations on various planes between the various parts of the system.

Thus, the present invention relates to a lighting system as defined in basic terms in the appended claim 1 and, in the additional features thereof, in the dependent claims.

Besides being particularly simple to make and assemble, the lighting system allows a wide variety of different spatial configurations to be created, also three-dimensional (i.e. extending not only in two different directions, but in three directions) and with different inclinations on different planes between the various parts of the system.

The system of the invention is characterized, in particular, by the configuration of the joints, which join the various lighting units forming the system.

In particular, such joints allow a flexible light distribution in the space according to continuous lines of devices. Flexible spatial distributions are thus possible, both on a plane and also varying in height, for example, to follow variations in architecture (such as stairs or different ceiling levels) or to position the light sources at different heights (which may be opportune, for example, to pass from lighting above a work station or a desk, which needs a lower lighting device, to a passage space, where a higher lighting device is needed).

Furthermore, the joints not only fulfil the function of a mechanical connection, but they also fulfil the function of an electrical connection, having an internal geometry, which allows the passage, inside the joints themselves, of the system power supplying and controlling cables.

The components of the joints are further shaped so as to be used in the system in various positions and in different orientations: thus, the number of different components, which need to be made, is reduced, with important advantages in terms of production.

BRIEF DESCRIPTION OF THE DRAWINGS

The features and advantages of the present invention will become clear from the description of the following non-limiting examples of embodiments, with reference to the appended figures, wherein.

DETAILED DESCRIPTION

Figure 1:
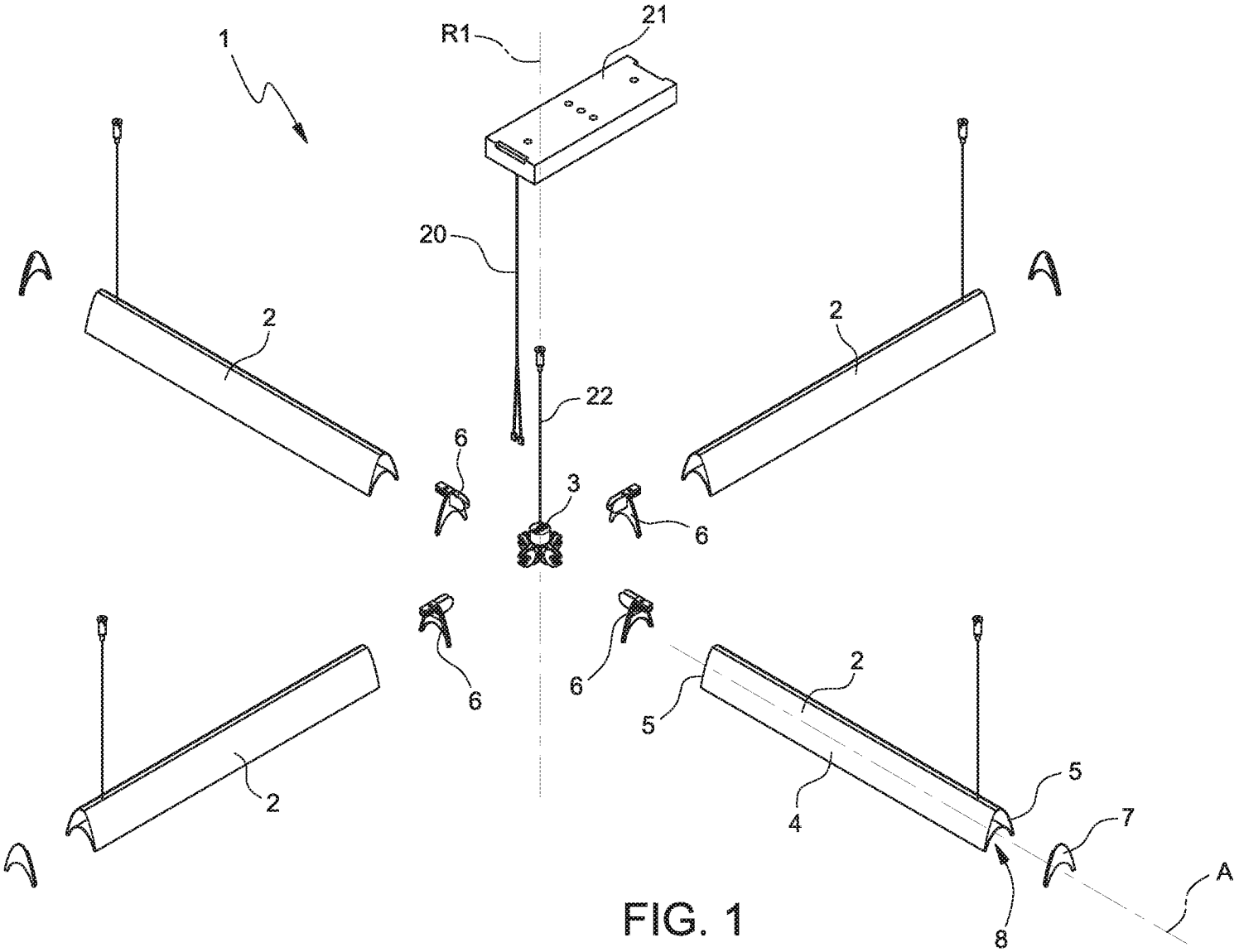
FIG. 1 is a partially exploded, perspective schematic view of a lighting system according to the invention, assembled in an example configuration.

With reference to FIG. 1, a lighting system 1 comprises a plurality of lighting units 2 and at least one joint 3 joining two or more units 2.

The system 1 can comprise two or more units 2, variously connected to one another by joints 3.

Each joint 3 can connect two, three or four units 2.

In the non-limiting illustrative example, the system comprises four units 2 connected by a joint 3.

The units 2 can have various shapes.

In the non-limiting illustrative example (but not necessarily) the units 2 are substantially equal to one another.

Each unit 2 comprises a hollow body 4 elongated longitudinally along an axis A between two opposite longitudinal ends 5, one of which connected to the joint 3 by means of a connection head 6 and the other closed by a closing head 7. It is understood that both ends 5 of the unit 2 can be connected to respective joints 3 (to form variously configured systems 1) and thus have respective connection heads 6.

The body 4 has an emission opening 8, extending parallel to the axis A, and houses a light source (known and not illustrated for simplicity), for example, a strip of LEDs aligned along the axis A, optionally associated with an appropriate element or optical group.

Figure 2:
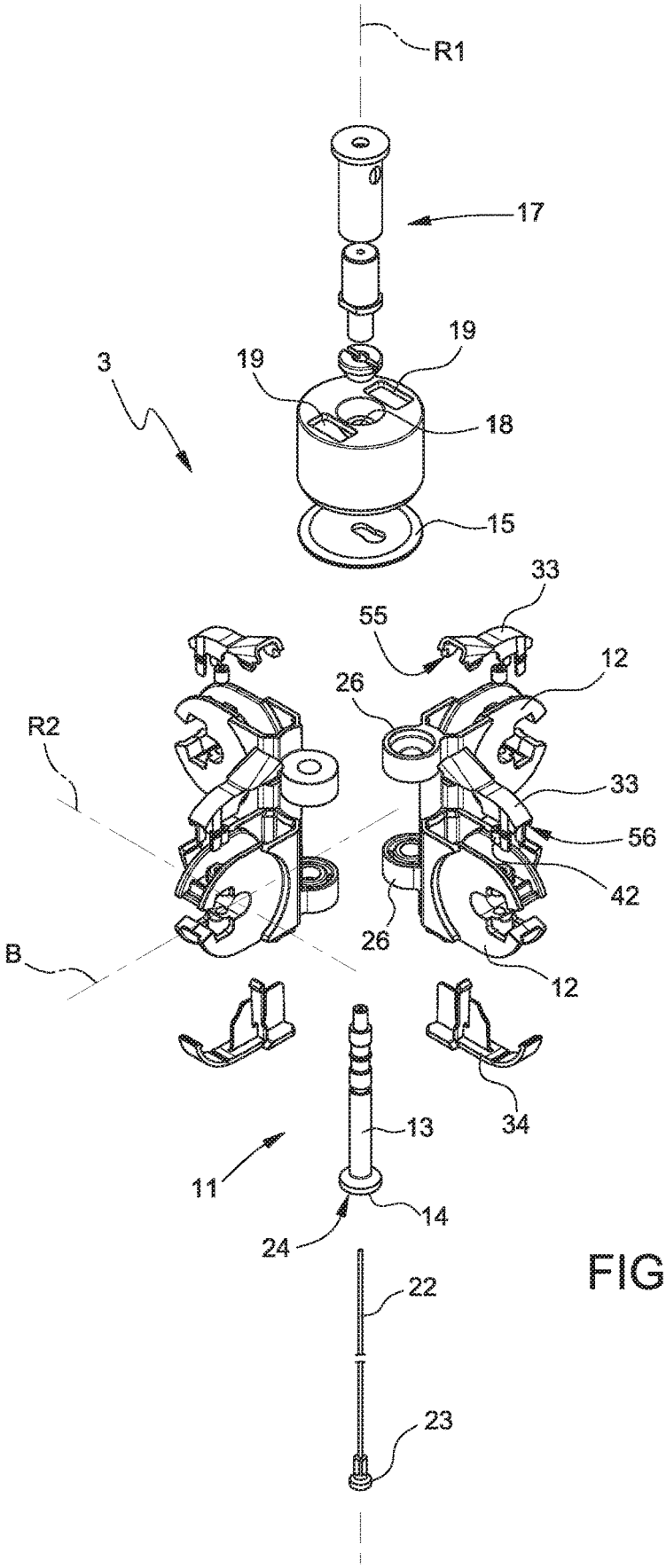
FIG. 2 is an exploded perspective view of a component of the system in FIG. 1.
Figure 3:
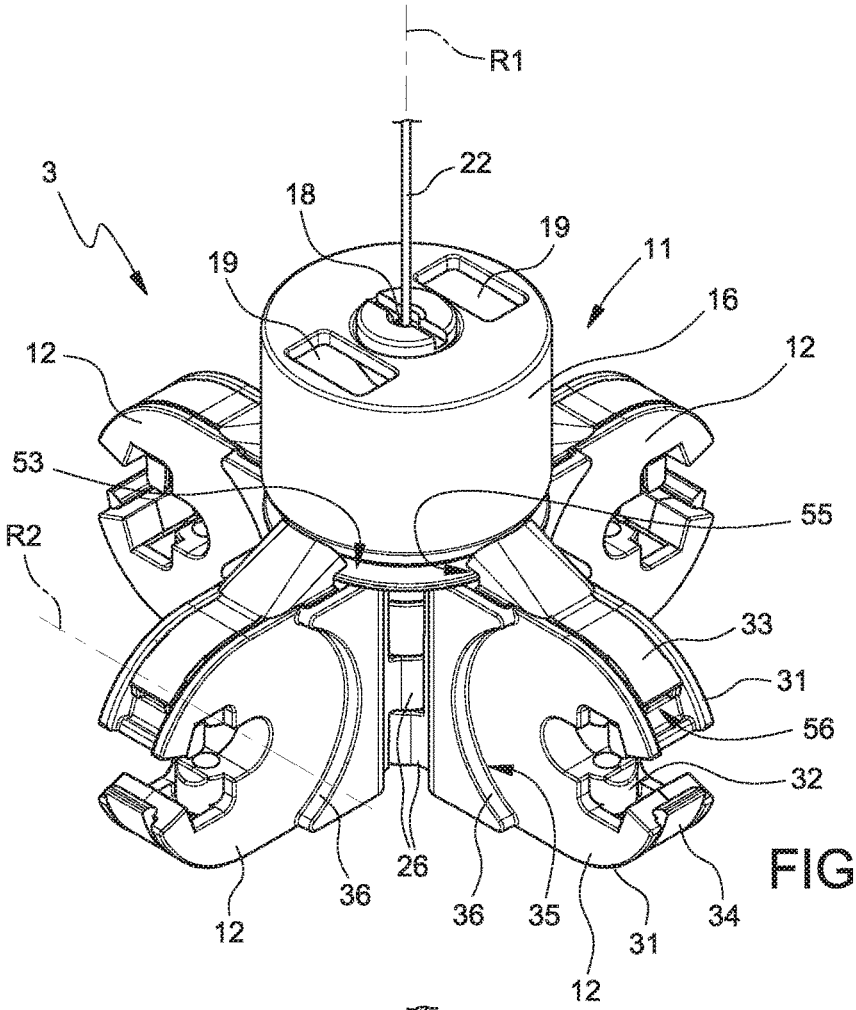
FIGS. 3 and 4 are a perspective view and a longitudinal section view respectively of an assembled detail of the component in FIG. 2.
Figure 4:
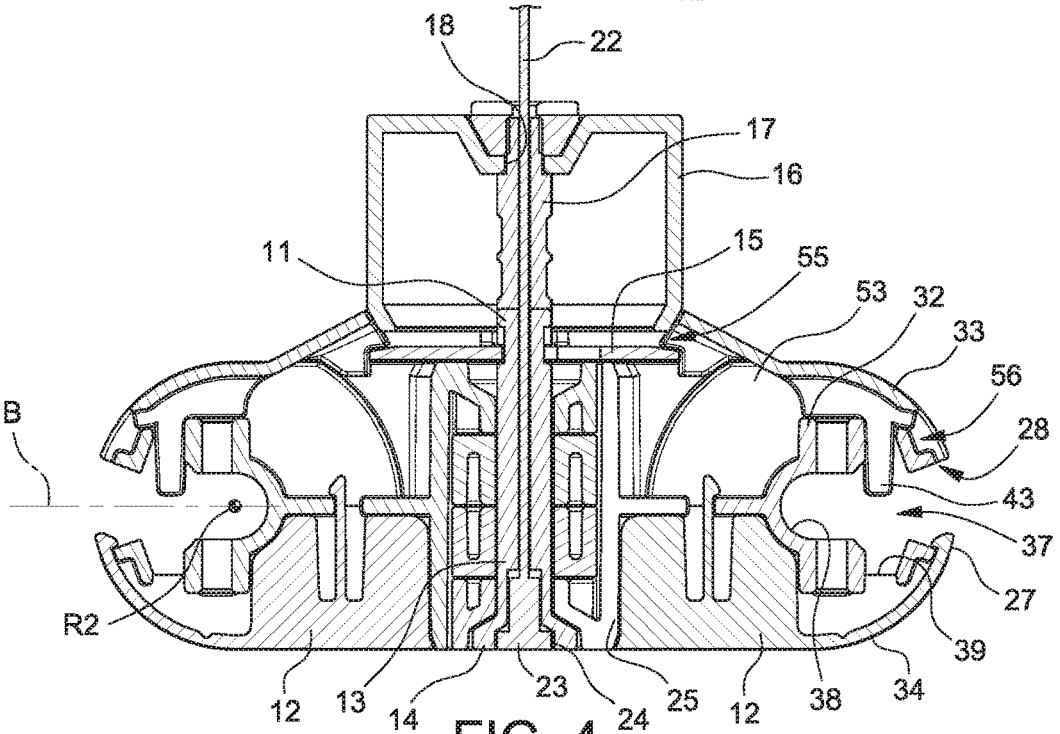

Also, with reference to FIGS. 2-4, the joint 3 comprises a central support 11 extending along an axis R1 and a plurality of arms 12 (two or more), which project radially from the support 11 and are hinged in a rotary manner to the support 11.

In particular, the support 11 comprises a pin 13 extending along the axis R1 and having a lower end flange 14 and an upper cover flange 15.

Optionally, the support 11 also comprises a cap 16 positioned above the flange 15 and fixed to the flange 15 by means of a stem 17 arranged through a central hole 18 of the cap 16 and joined to the pin 13. The cap 16 has substantially an inverted cup shape and is provided with at least one entry opening 19 formed passing through the cap 16 and specifically, through a top wall of the cap 16; in the illustrated example, the entry opening 19 is defined by a pair of windows, which are diametrically opposite with respect to the hole 18.

The entry opening 19 allows the insertion of one or more cables 20, for example, power supplying and controlling cables for the system 1 (i.e. for the units 2) connected to a power supply 21 or another power supplying and controlling device.

The pin 13 is optionally connected to a suspension cable 22, which allows, for example, to hang the system 1 to a ceiling.

Preferably, the pin 13 is hollow inside (i.e. it has a tubular structure) and the suspension cable 22 is housed inside the pin 13, where one end of the suspension cable 22 is hooked to a head 23, which axially engages a locking seat 24 formed, for example, in the flange 14.

Each arm 12 substantially extends along a longitudinal axis B perpendicular to the axis R1 between a root rim 25, provided with a connection ring 26 hinged in a rotary manner to the pin 13; and a free end rim 27, opposite the root rim 25 and provided with a front access opening 28.

Figure 5:
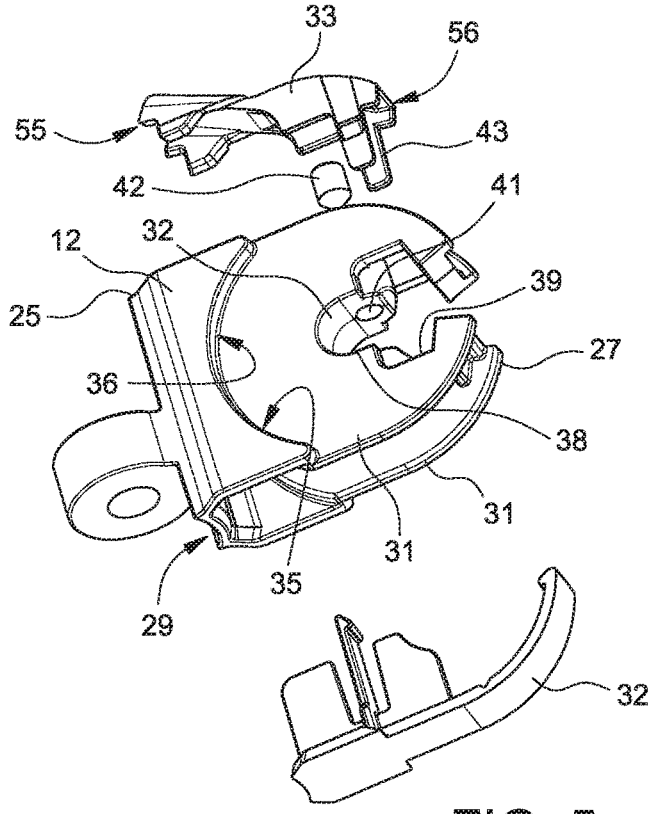
FIGS. 5 and 6 are an exploded perspective view and an exploded side view respectively of a detail of the system in FIG. 1.
Figure 6:
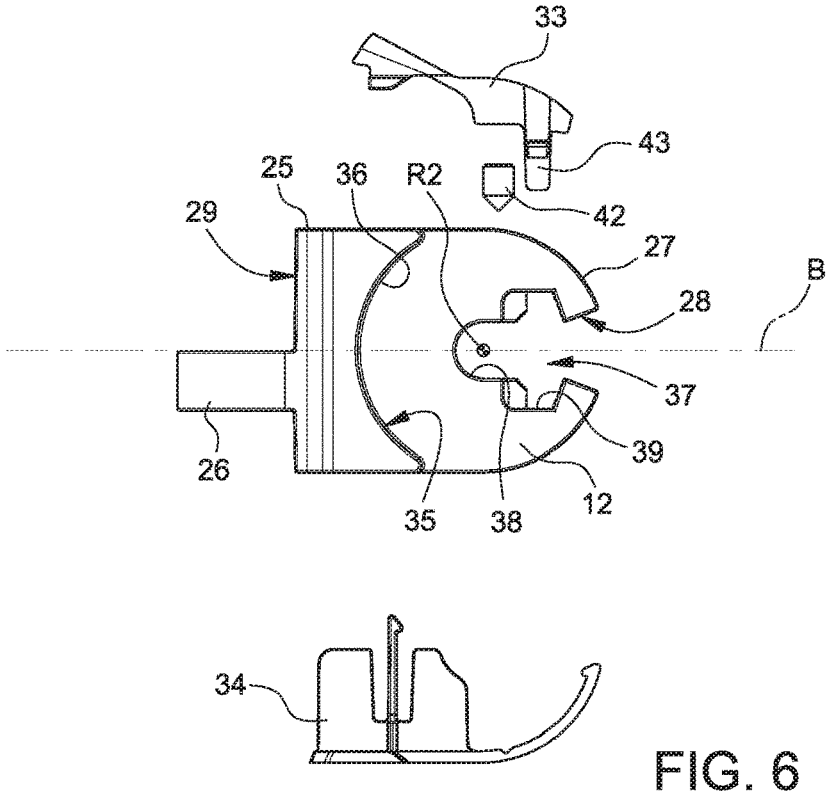

In greater detail and also with reference to FIGS. 5-6, the ring 26 is fitted on the pin 13 so as to be rotatable, together with the arm 12 as a whole, with respect to the pin 13 and about the axis R1, defining a first rotation axis of the joint 3.

The ring 26 extends from an outer surface 29 of the root rim 25; advantageously, the surface 29 is a curved surface (having an arc of a circle cross section).

The arm 12 comprises a pair of lateral sides 31 parallel to the axis B, which extend from the root rim 25; a transverse core 32, which joins the sides 31; an upper closing element 33 and a lower closing element 34, which join the sides 31 along an upper edge and a lower edge of the arm 12 respectively.

The sides 31 have substantially circular respective lateral rotation seats 35, delimited at the back (from the part of the root rim 25) by respective circle-arc shaped shoulders 36 facing the free end rim 27.

The opening 28 opens on the free end rim 27 and communicates with an inner through seat 37 formed inside the arm 12 between the sides 31.

The seat 37 comprises a substantially semi-cylindrical central rotation seat 38, extending along and about an axis R2 defining a second rotation axis of the joint 3 orthogonal to the axis R1; and an enlarged portion 39 positioned between the seat 38 and the opening 28.

The seat 38 is aligned with the opening 28 along the axis B of the arm 12 and the portion 39 extends laterally on opposite sides of the axis B with two opposing cavities.

The core 32 is provided with at least one threaded service hole 41, for example, substantially perpendicular to the axis B and parallel to the axis R1, communicating with the seat 37 and, specifically, with the seat 38 and housing a locking member 42, for example, a pin, which screws into the hole 41.

The closing elements 33, 34 connect the sides 31 on opposite sides of the axis B and are joined to the sides 31 and/or to the root rim 25. One of the closing elements 33, 34, for example, the upper closing element 33, is provided with an appendage 43 (in the illustrated example, shaped like a fork and having two fingers set side-by-side), which is substantially perpendicular to the axis B and parallel to the axis R1 and which extends in the seat 37 and in particular in the upper cavity of the seat 37 and faces the seat 38.

According to the invention, the joint 3 can comprise a different number of arms 12, in particular two, three or (as in the illustrated example) four arms 12.

The arms 12 of the joint 3 extend radially from the support 11 and are angularly spaced apart from one another about the axis R1. The arms 12 are all positioned at the same height along the axis R1 with respect to the support 11, and have the respective rings 26 positioned on the pin 13 at different heights (measured along the axis R1) along the pin 13.

Thus, the arms 12 have the respective rings 26 axially staggered and superimposed axially along the axis R1.

Also depending on the number of arms 12 extending from the support 11 (and therefore of rings 26 positioned on the pin 13), one or more spacer washers (not shown) can be mounted on the pin 13 between pairs of rings 26 of respective arms 12.

The rings 26 are rotatable on the pin 13 about the axis R1, thus allowing the rotation of the respective arms 12 with respect to the support 11 and with respect to one another about the axis R1. All of the arms 12 are rotatable about the same rotation axis, defined by the axis R1, independently of one another.

The seat 37 is shaped so as to receive and support a connection head 6 of a unit 2.

Figure 7:
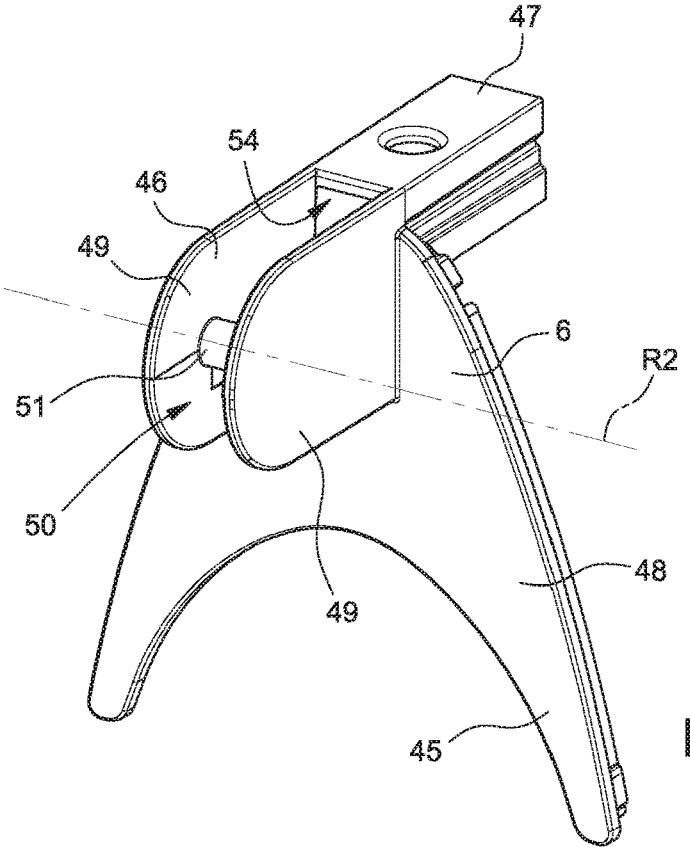
FIGS. 7 and 8 are a perspective view and a longitudinal section view respectively of a further detail of the system in FIG. 1.
Figure 8:
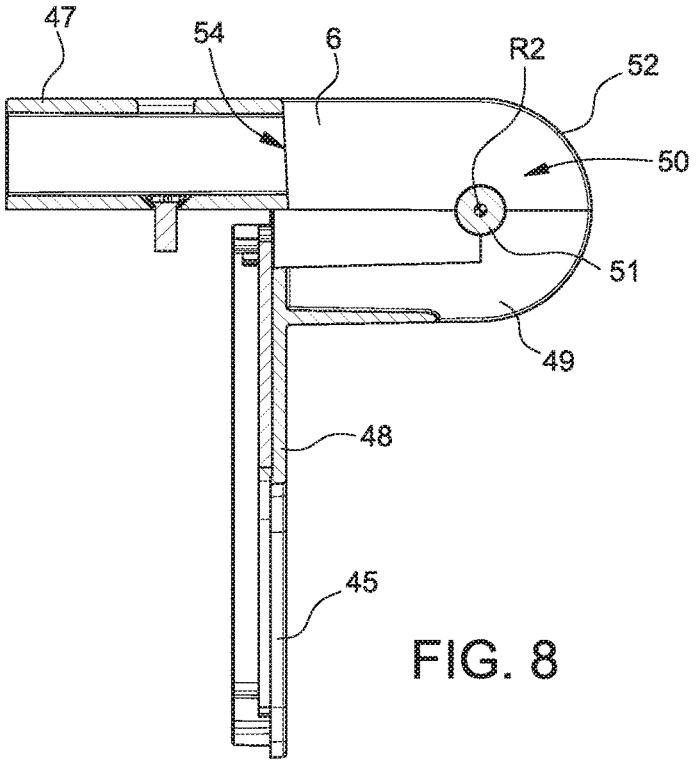

As shown in detail in FIGS. 7-8, the head 6 comprises a closing portion 45, shaped so as to hook and close one end 5 of the unit 2, and a coupling portion 46, shaped to engage the seat 37 in a rotary manner.

In particular, the closing portion 45 comprises an internally hollow tubular profile 47 and a closing plate 48, extending from a lower rim of the profile 47, substantially perpendicular to the profile 47 and shaped so as to close the end 5 of the unit 2.

The coupling portion 46 comprises a pair of side walls 49 set side-by-side and parallel to each other, which extend from the closing portion 45, opposite the profile 47.

The walls 49 are laterally spaced apart from each other and delimit an inner cavity 50, in which a central cross pin 51 extends, positioned between the walls 49 in the cavity 50.

The pin 51 is perpendicular to the walls 49.

The walls 49 have respective free end edges 52 curved in an arc of a circle.

With the joint 3 mounted, the pin 51 is housed in the seat 37 and engages, in particular, the central rotation seat 38; thus, the pin 51 extends, in turn, along the axis R2 defining the second rotation axis of the joint 3, orthogonal to the axis R1.

The sides 31 of the arm 12 are inserted in the cavity 50 between the walls 49; the walls 49 are positioned on respective sides 31 and engage the lateral rotation seats 35 on the sides 31; the free end edges 52 of the walls 49 cooperate with respective shoulders 36.

The pin 51 can be inserted in the seat 37 through the access opening 28 to engage the central rotation seat 38.

In the assembly step, the head 6 can be supported by the portion 39 of the seat 37 before the final fixing thereof, which occurs, for example, by means of the locking member 42 inserted in the hole 41, which presses on an outer side surface of the pin 51.

The closing element 33 then closes the pin 51 in the seat 38 by means of the appendage 43.

The joint 3 is configured to house internally the power supplying and controlling cable 20 (or cables) for the system 1. Therefore, the joint 3 comprises (FIGS. 3-4) internal passages 53, formed, in particular, inside the cap 16 and each arm 12, between the entry opening 19 and respective exit openings 54 (FIGS. 7-8) formed on respective heads 6.

In particular, for the passage of the power supplying and controlling cable 20 (or cables), besides the entry opening 19 on the cap 16, the joint 3 has a pair of passage openings 55, 56 on each arm 12, formed, in particular, at respective opposite ends of the closing element 33, above the flange 15 and on the free end rim 27 (FIG. 5) respectively. The cable 20 enters the cap 16 through the entry opening 19, passes through the arm 12 passing into the openings 55, 56, optionally guided by the fork appendage 43, and reaches the head 6 and, in particular, the profile 47 through the exit opening 54.

It is clear from what is described and illustrated that the system 1 can assume multiple configurations. Starting from few basic components (units 2, joints 3, connection heads 6, closing heads 7), it is possible to compose a system 1 of various shapes and sizes, also with three-dimensional development.

Each joint 3 can not only connect a different number of units 2, but it also allows each unit 2 to rotate with respect to two rotation axes R1, R2, orthogonal to each other.

Finally, it is understood that further modifications and variations can be made to the modular lighting system described and illustrated herein, which do not go beyond the scope of the appended claims.

What is claimed is:

1. A lighting system comprising:

a plurality of lighting units and at least one joint which joins two or more units; the joint comprising a central support extending along a first rotation axis (R1) and two or more arms which extend radially from the support and are hinged in a rotary manner to the support to rotate with respect to the support about the first rotation axis (R1);

wherein each arm is hinged in a rotary manner about a second rotation axis (R2), orthogonal to the first rotation axis (R1), to a connection head fixed to a lighting unit;

wherein the support comprises a cap coupled to a flange of the support above the two or more arms extending radially from the support, the cap substantially comprising an inverted cup shape and being provided with at least one entry opening passing through an upper wall for the passage of one or more cables; and wherein the joint comprises internal passages, formed inside the cap and each arm, between the entry opening and respective exit openings formed on respective connection heads, so as to house, inside the joint, one or more cables.

2. A system according to claim 1, wherein the support comprises a pin extending along the first rotation axis (R1); and the arms comprise respective rings fitted on the pin and axially staggered and axially superimposed along the pin and along the first rotation axis (R1).

3. A system according to claim 2, wherein the arms are all positioned at the same height along the first rotation axis (R1) with respect to the support, and the respective rings are positioned on the pin at different heights along the pin.

4. A system according to claim 1, wherein each arm has a seat shaped so as to receive and support in a rotary manner a coupling portion of a connection head of a unit.

5. A system according to claim 4, wherein the coupling portion comprises a cross pin, which engages a substantially semi-cylindrical central rotation seat, formed in the seat and extending along and about the second rotation axis (R2).

6. A system according to claim 5, wherein the arm is provided with at least one threaded service hole communicating with the central rotation seat and housing a locking member cooperating with the cross pin of the connection head.

7. A system according to claim 4, wherein each arm has a pair of lateral sides provided with substantially circular respective lateral rotation seats, delimited at the back by respective circle-arc shaped shoulders; and the coupling portion comprises a pair of side walls facing and parallel to each other, which engage respective lateral rotation seats on the sides and have respective free end edges curved in an arc of a circle cooperating with respective shoulders.

8. A system according to claim 4, wherein the seat comprises an enlarged portion positioned between the central rotation seat and a front access opening formed on a free end rim of the arm.

9. A system according to claim 4, wherein the arm comprises a closing element provided with an appendage, substantially parallel to the first rotation axis (R1), which extends in the seat, facing the central rotation seat.

10. A system according to claim 1, wherein the cap couples axially to the flange via a stem arranged through a central hole of the cap.

11. A joint joining two or more lighting units of a lighting system, the joint comprising:

a central support extending along a first rotation axis (R1) and two or more arms, which extend radially from the support and are hinged in a rotary manner to the support to rotate with respect to the support about the first rotation axis (R1);

wherein each arm is hinged in a rotary manner about a second rotation axis (R2), orthogonal to the first rotation axis (R1), to a connection head fixed to a lighting unit;

wherein the support comprises a cap coupled to a flange of the support above the two or more arms extending radially from the support, the cap comprising an inverted cup shape and being provided with at least one entry opening passing through an upper wall for the passage of one or more cables; and wherein the joint comprises internal passages so as to house, inside the joint, one or more cables.

12. A joint according to claim 11, wherein the support comprises a pin extending along the first rotation axis (R1); and the arms comprise respective rings fitted on the pin and axially staggered and axially superimposed along the pin and along the first rotation axis (R1).

13. A joint according to claim 12, wherein the arms are all positioned at the same height along the first rotation axis (R1) with respect to the support, and the respective rings are positioned on the pin at different heights along the pin.

14. A joint according to claim 11, wherein each arm has a seat shaped so as to receive and support in a rotary manner a coupling portion of a connection head of a unit.

15. A joint according to claim 14, wherein the coupling portion comprises a cross pin, which engages a substantially semi-cylindrical central rotation seat, formed in the seat and extending along and about the second rotation axis (R2).

16. A joint according to claim 11, wherein the cap couples axially to the flange via a stem arranged through a central hole of the cap.

* * * * *